US007735700B2

(12) United States Patent
Ruikka et al.

(10) Patent No.: US 7,735,700 B2
(45) Date of Patent: Jun. 15, 2010

(54) BIN GATE FOR PROVIDING VARIABLE OUTPUT FLOW RATES

(75) Inventors: Anders M. Ruikka, Zimmermann, MN (US); Paul D. Gill, Elk River, MN (US); Richard A. Johnson, Isanti, MN (US); Dale A. Kratochwill, Andover, MN (US)

(73) Assignee: Cretex Companies, Inc., Elk River, MN (US)

( * ) Notice: Subject to any disclaimer, the term of this patent is extended or adjusted under 35 U.S.C. 154(b) by 1070 days.

(21) Appl. No.: 11/384,175

(22) Filed: Mar. 17, 2006

(65) Prior Publication Data

US 2007/0215238 A1 Sep. 20, 2007

(51) Int. Cl.
*B65D 47/00* (2006.01)

(52) U.S. Cl. ..... 222/561; 222/239; 222/273

(58) Field of Classification Search ..... 222/238, 222/481, 556–561, 545, 326, 239, 272, 273, 222/504; 251/326; 414/519, 520; 366/196; 198/669; 141/67, 83, 94, 198
See application file for complete search history.

(56) References Cited

U.S. PATENT DOCUMENTS

| | | | | |
|---|---|---|---|---|
| 1,488,228 | A * | 3/1924 | Burns | 222/202 |
| 4,278,190 | A | 7/1981 | Oory et al. | |
| 4,597,510 | A * | 7/1986 | Durant | 222/195 |
| 5,667,108 | A * | 9/1997 | Braun et al. | 222/181.1 |
| 6,578,743 | B1 * | 6/2003 | Kokeisl | 222/506 |

* cited by examiner

*Primary Examiner*—Gregory L Huson
*Assistant Examiner*—Jason K Niesz
(74) *Attorney, Agent, or Firm*—Stuart R. Hemphill; Dorsey & Whitney LLP

(57) ABSTRACT

An assembly for controlling delivery of material from a bin opening includes a movable bin gate for closing the bin opening and providing a high flow rate of material when the movable gate is open, wherein a low flow aperture is formed in the bin gate to provide a low flow rate of material when the bin gate is positioned such that only the low flow aperture is open. A two-stage flow enhancer within the bin includes a first stage for impelling material in the direction of the low flow aperture and a second stage for impelling material to exit through the low flow aperture. A controller controls operation of the bin gate to adjust a flow rate of material from the bin opening.

18 Claims, 12 Drawing Sheets

BIN GATE FOR PROVIDING VARIABLE OUTPUT FLOW RATES

FIELD OF THE INVENTION

The present invention relates to an assembly for controlling delivery of material from a bin in which a movable bin gate used to open and close the bin opening has a low flow aperture formed in it. A control system and actuator position the bin gate to select high and low flow rates that enable improved control over the amount of material dispensed from the bin.

BACKGROUND OF THE INVENTION

The production of concrete and other similar composite materials that include components such as sand, aggregate, gravel, cement, fly ash, and/or other granular (including powdered) ingredients may be aided by providing controllable feed bins containing each of the necessary ingredients. The ingredients are distributed from the bins into a receiving bin or onto a conveyor belt that carries the ingredients to a mixing device or chamber. Alternatively, the bins may deliver the various ingredients directly into a mixing device.

Evolving applications for concrete and similar composite materials require increased precision in terms of the amount of various ingredients that are needed to achieve the desired composition and resulting qualities of the final composite material. Hand measuring or adjustment of amounts is possible but inefficient. Thus, there is a need for precise control of the amount of material distributed from a bin in order to achieve the desired composition.

To achieve precise distribution of materials from bins, one approach is to provide a bin having a large opening and a small opening. However, past arrangements having a large and a small opening have created the two openings by equipping the bins with two movable bin gates and therefore require a second, additional control mechanism for the second gate. Such an arrangement is described in U.S. Pat. No. 4,278,290 (Oory et al.). One drawback of such arrangement is the expense of specially equipping each bin with multiple gates and control mechanisms. An additional drawback to such arrangements is that certain types of material tend to get jammed or stuck inside the bin when only a small output opening is provided. This limits the types of material that may be dispensed by the bin.

Thus, there is a need for a bin gate assembly that enables increased precision in the control of the output quantities provided from the bin opening while minimizing the need for additional equipment and mitigating the jamming/sticking issues of past arrangements.

SUMMARY OF THE INVENTION

The present invention provides an assembly and method for controlling delivery of material from a bin opening having a low flow aperture formed in a bin gate that enables precise and efficient control of output amounts distributed from the bin opening. The assembly according to the present invention is further designed to aid material flow out of the bin opening through the low flow aperture without substantial jamming or blocking. In particular, paddles are provided to facilitate movement of material in the bin toward the low flow aperture and then out through the low flow aperture.

An assembly for controlling delivery of material from a bin opening in accordance with the present invention includes a movable bin gate for closing the bin opening and providing a high flow rate of material when the bin gate is open, wherein a low flow aperture is formed in the bin gate to provide a low flow rate of material when the bin gate is positioned such that only the low flow aperture is exposed. The bin gate also provides a variable higher flow rate as the gate moves from a high-flow open position to the position in which only the low flow aperture is exposed. The assembly also includes a controller for controlling operation of the bin gate to select a flow rate of material from the bin opening. A two-stage flow enhancer includes a first stage for impelling material in the direction of the low flow aperture and a second stage for aiding material to exit through the low flow aperture. The assembly may use a control system to measure amounts delivered and to select high and low flow rates and gate closing to achieve accurately measured dispensing from a bin.

These and other features and advantages of the present invention will become apparent to those skilled in the art from the following detailed description, wherein it is shown and described illustrative embodiments of the invention, including best modes contemplated for carrying out the invention. As it will be realized, the invention is capable of modifications in various aspects, all without departing from the spirit and scope of the present invention. Accordingly, the drawings and detailed description are to be regarded as illustrative in nature and not restrictive.

DETAILED DESCRIPTION

The assembly and system will now be described in detail with reference to accompanying drawings.

Figure 1:
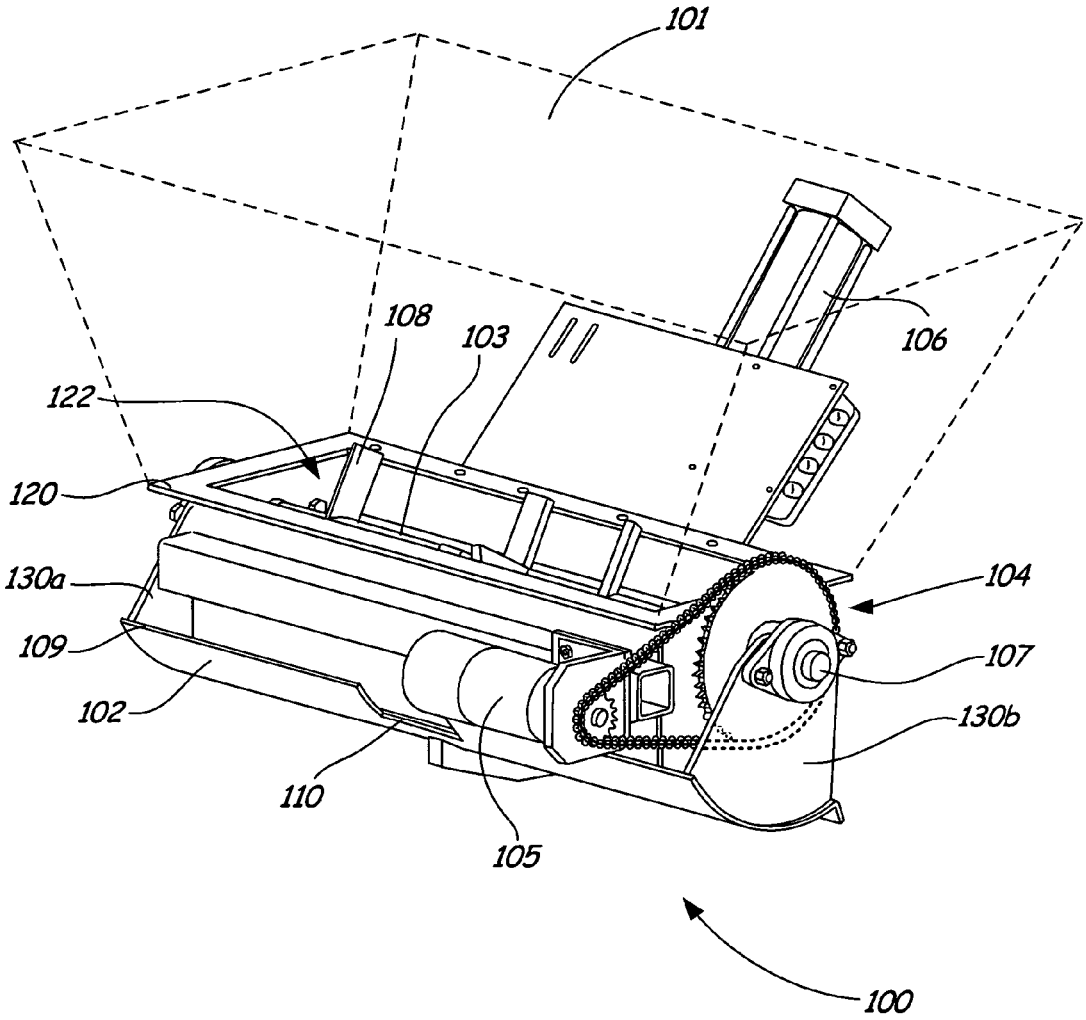
FIG. 1 provides a pictorial view of a bin gate assembly for controlling delivery of material, with a bin containing material shown in phantom.

FIG. 1 provides a diagram of an assembly 100 for providing variable output flow rates for material contained within an open top bin 101 (shown in phantom). Material contained by bin 101 may include particulate materials such as sand, aggregate, gravel, fly ash, cement, or other granulated materials that are ingredients in preparing composite mixtures. As used herein, granulated materials include not only sand, aggregate, gravel, cement, and fly ash, but also fine particulate or powdered materials and additives such as colorants, retarders, air entrainers, plasticizers, etc. In assembly 100, bin 101 is provided for holding and distributing material, such as one of the components needed to create a concrete mixture. At the bottom opening 122 of the bin 101 is a bin gate frame 120 formed in the shape of a substantially rectangular box with a curved bottom portion and an open top for attachment to the bottom opening of the bin 101. However, other bin gate frame shapes and bins with top covers or having other shapes, e.g., cylindrical, that enable complete closure and opening of the bin by a gate may also be used. The common feature of suitable bins is a bottom opening from which the bin contents flow by action of gravity and the ability to close the bottom opening.

Figure 3:
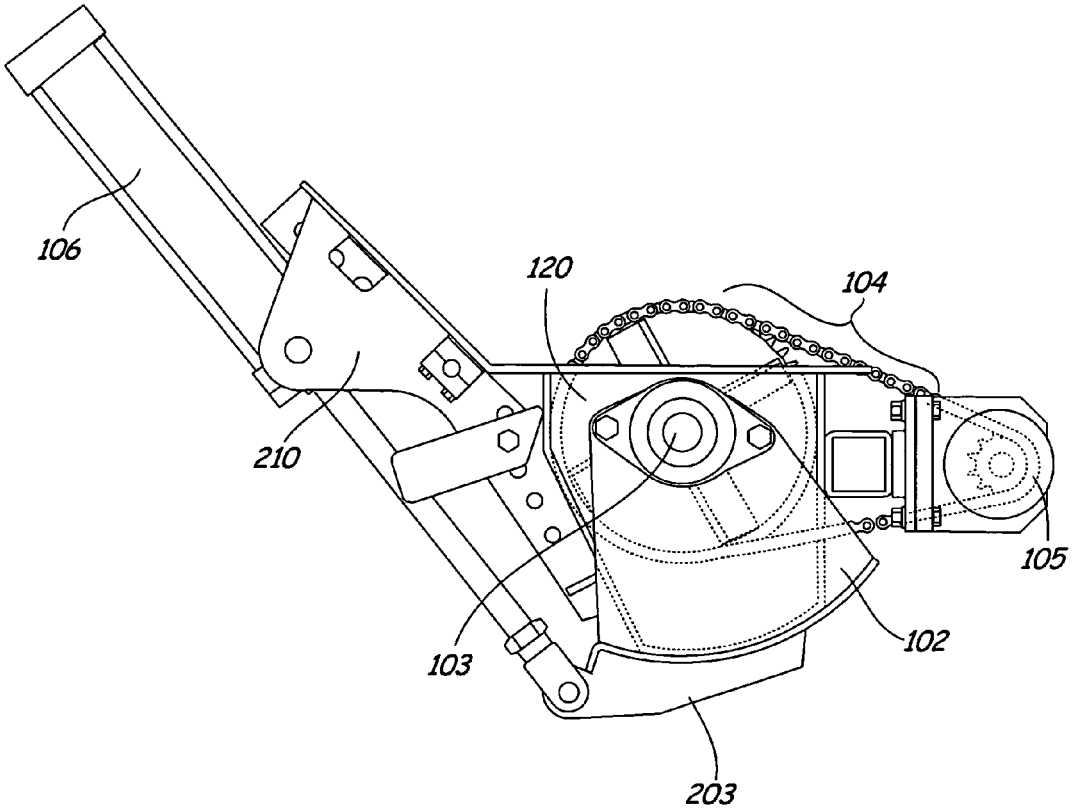
Figure 4:
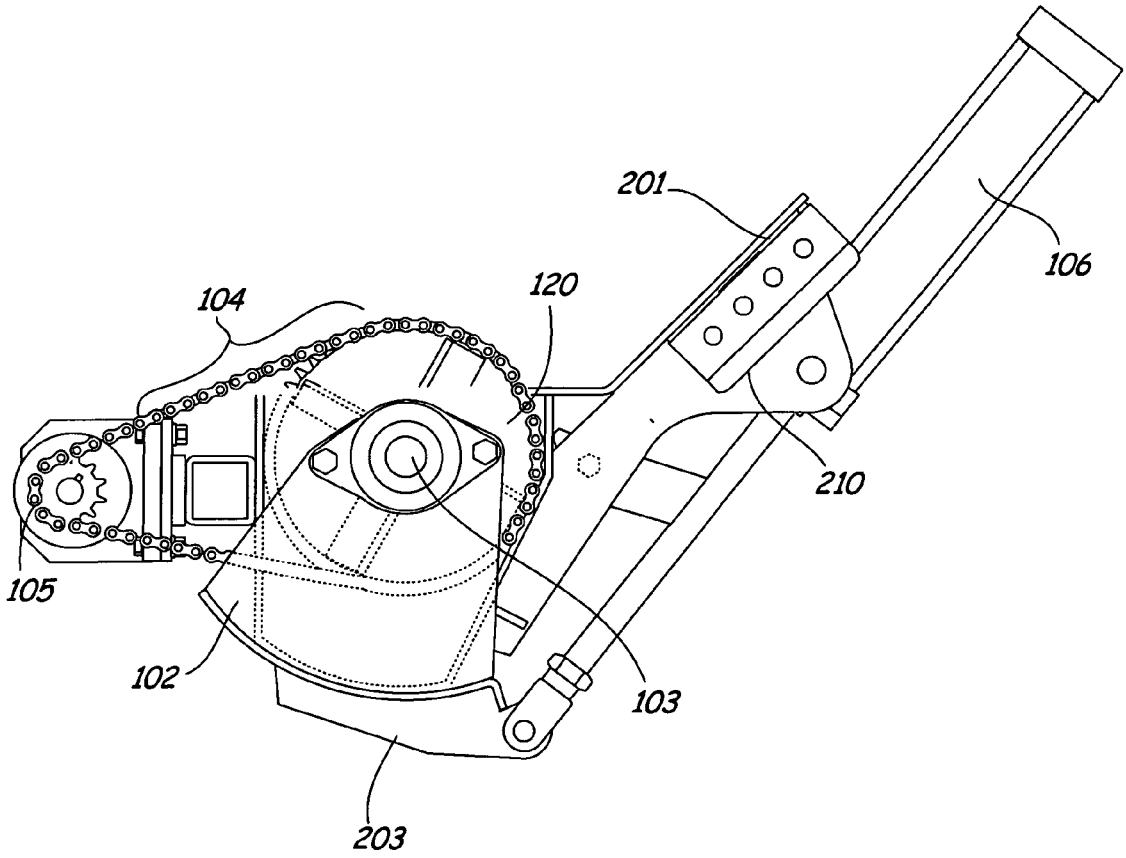

The rectangular bottom opening 122 of the bin 101 has mated to it a bin gate frame 120 with a bin gate 102 shaped to form a closed bottom of the bin 101 when the gate 102 is in a fully closed position as shown in FIG. 1. The gate 102 has end plates 130*a*, 130*b* permitting it to be mounted to rotate around an axis defined by a rotating shaft 103 than runs lengthwise through the center of the bin gate frame 120. Paddles 108 are coupled to the rotating shaft 103 for moving the material in the bin gate frame 120 as will be described below in further detail with reference to FIGS. 7, 8, and 8A. A motor 105 and gear-chain assembly 104 control rotation of the rotating shaft 103. Additional detail concerning the attachment of the bin gate 102 to swing on shaft 103 is depicted in FIGS. 3 and 4. An actuator 106 is provided to control movement of the gate 102, which is movably coupled to shaft 103 by fastener assemblies 107 (visible in FIG. 1 at only one end of shaft 103) that enable independent movement of the gate 102 with respect to the rotating shaft 103. Other mechanisms for controlling rotation of shaft 103 and for positioning the bin gate 102 may be used in place of those illustrated in FIG. 1.

As illustrated in FIG. 1, a notch formed in an outer edge 109 of bin gate 102 forms a low flow aperture 110. The low flow aperture 110 is rectangular and positioned substantially centrally along outer edge 109 of bin gate 102. However, different low flow aperture shapes, such as arched or V-shaped, may be used, and one or more apertures 110 may be formed at different positions along the edge 109 of bin gate 102 or within the surface of the bin gate 102 in order to enable the level of precision desired for distribution of material through the aperture 110. To provide increased dispensing precision when the low flow rate is employed instead of a high flow rate, the area of the low flow aperture 110 is less, preferably substantially less, than a typical opening used for a high flow rate. For example, the low flow aperture 110 may have an opening area that is a factor of at least two, and preferably at least five to ten, times less than the typical opening area used for a higher flow rate from the bin 101, e.g., when the bin gate 102 is fully open.

The formation of the low flow aperture 110 in bin gate 102 as shown herein improves over operation of a conventional bin gate (having no low flow aperture) that affects a lower flow rate by partially closing the bin gate. For example, operation of a conventional bin gate in this manner to achieve a lower flow rate may still leave a large aperture and provide less accurate control over the flow rate of material from the bin. Also, the narrow opening created by a nearly closed conventional bin gate may result in jamming or sticking of materials to be dispensed that have larger particulate size or clump readily, requiring further opening of the bin gate or manual intervention to restart the flow of the material and providing for uneven dispensing of material from the bin. Accordingly, the assembly 100, in which a low flow aperture 110 with roughly equal height and width dimensions is provided in bin gate 102, enables more precise control of the flow rate of material from the bin and reduces sticking and jamming of material flowing from the bin. Additional features of the assembly 100 as described in detail below also facilitate the flow of material through the low flow aperture 110.

With reference to FIG. 1, the bin gate 102 in assembly 100 may be, for example, an arcuate plate having dimensions of about 10 inches by 32 inches. The low flow aperture 110 may have the dimensions of approximately 1¼" by 5¾" to enable a flow rate of approximately 0.5 pounds (6 cubic inches) of material per second for a typical concrete batch material. The size of the low flow aperture 110 relative to that of the higher flow apertures affects the level of precision achievable for metering material from the bin 101. Thus, the aperture size may be selected based upon a flow rate per second that allows control of the metered amounts on an absolute weight or volume per second basis and/or as a percentage of typical mixing batch size.

Figure 2:
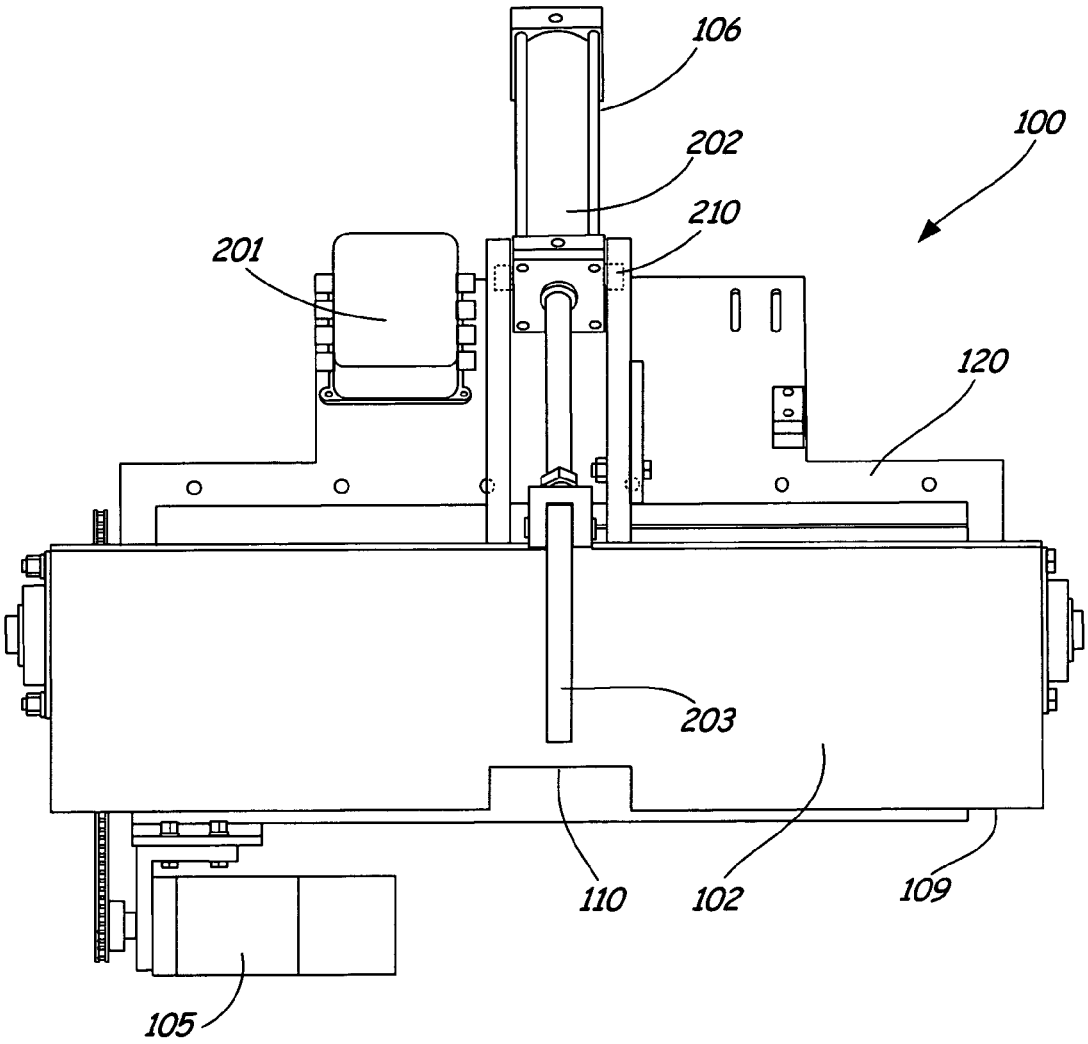
FIGS. 2-4 provide bottom, right side, and left side views of the assembly shown in FIG. 1.

FIG. 2 provides a diagram of assembly 100 in which bin gate 102 is in the fully closed position, as in FIG. 1. A controller 201 is provided to control operation of the motor 105 and the actuator 106. Actuator 106 comprises a cylinder 202 anchored on a base frame 210 with its actuating arm operably attached to bin gate 102. Controller 201 controls the cylinder 202 via a flow control valve (not shown). Cylinder 202 is coupled to the bin gate 102 by a flange 203 fixedly attached to or integrally formed on bin gate 102. By operation of the cylinder 202 as controlled by controller 201, the position of bin gate 102 along its arcuate path of motion around shaft 103 may be controlled and adjusted. By selecting the position of the bin gate 102, the controller 201 exposes all or only selected portions of the bin opening 122 for material flow. Controller 201 also controls operation of motor 105, which in turn controls rotation of the shaft 103 via gear-chain assembly 104.

Figure 5:
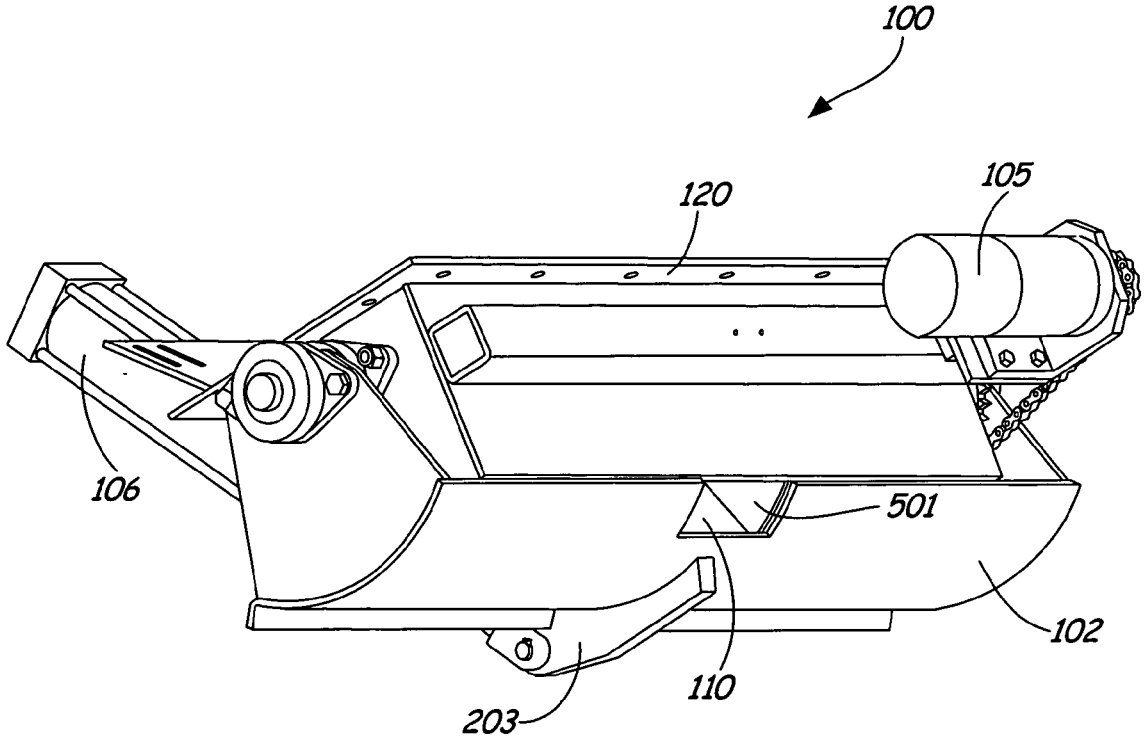
FIG. 5 provides a pictorial view from below of an assembly in which the bin gate is positioned to provide a low output flow rate.

FIG. 5 provides a diagram of an assembly in which the bin gate 102 is positioned such that the low flow aperture 110 is the only opening through which material may flow out of the bin 101. In this position, the assembly provides a relatively low output flow rate that permits more precise weight/volume control of delivered material. As noted, the aperture 110 may be designed to provide a flow rate of 0.5 pounds (approximately 6 cubic inches) per second for a typical material. Different flow rates may be achieved by varying the size and shape of the aperture 110. Vertical flow guide plates 501 are also provided within the bin gate frame 120 in order to reduce packing of the material in the bin gate frame 120 around the low flow aperture. Additional information concerning the vertical flow guide plates 501 is provided with reference to FIG. 6 below. As bin gate 102 is moved from a closed position (FIG. 1), to a low flow output position (FIG. 5), and then to an open position (FIG. 6), the flow rate of output from the bin 101 is selectively adjusted. Bin gate 102 maybe positioned in any intermediate position along its arcuate path of motion in order to select the output flow rate desired by the user of the assembly 100. Thus, either substantially the entire area of the low flow aperture 110 or some lesser portion of that area may be exposed to the bin opening to select a low flow rate. Similarly, either substantially the entire horizontal opening area of the bin gate frame 120 or some lesser portion of that area may be used to select a higher flow rate. In one embodiment, the controller 201 is configured to provide only a single low flow state, wherein substantially the entire area of the low flow aperture 110 is available for material flow, and a single high flow state, wherein substantially the entire aperture defined by the bin gate frame 120 and bin opening are available for material flow.

Figure 6:
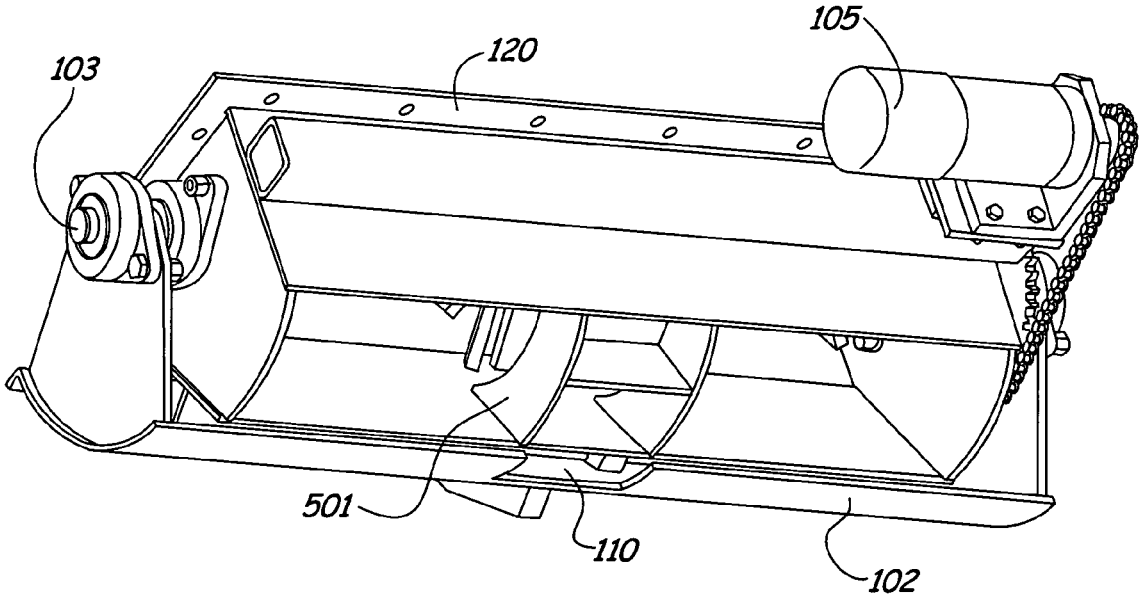
FIG. 6 is a pictorial view from below of the assembly in FIG. 5 positioned to provide a high output flow rate.

In FIG. 6, bin gate 102 is shown in a completely open position to enable a high flow rate of material out of the bin 101. Vertical flow guide plates 501 are also shown in more detail. The vertical flow guide plates 501 are provided below the rotating shaft 103 within the bin gate frame 120 and are aligned with the low flow aperture 110. (In alternative embodiments (not shown) in which the low flow aperture 110 is positioned in a different location within the bin gate 102, the vertical flow guide plates 501 are also differently positioned in order to align or cooperate with the low flow aperture 110.) When the bin gate 102 is in the open position (FIG. 6), these flow guide plates 501 allow material from the bin to fall freely from the bin 101. When the gate 102 is in the low flow position (FIG. 5), the vertical flow guide plates 501 help prevent packing of material in the bin gate frame 120 above the aperture 110, thus facilitating flow of the material from the bin through the aperture 110. The guide plates 501 may additionally serve a structural function by stiffening the bin gate 102.

In another embodiment, the bin gate 102 may be a flat plate that has a sliding motion rather than the swinging motion shown in FIGS. 1-6. In this embodiment, the low flow mode and the higher flow modes are attained by moving the flat plate to fully close the opening, to expose only the low flow aperture, or to expose all or a substantial portion of the bin opening to material flow. Such a flat plate bin gate may be horizontal or located at an angle near the bin bottom, as long as gravity works to deliver material to the bin opening.

Figure 7:
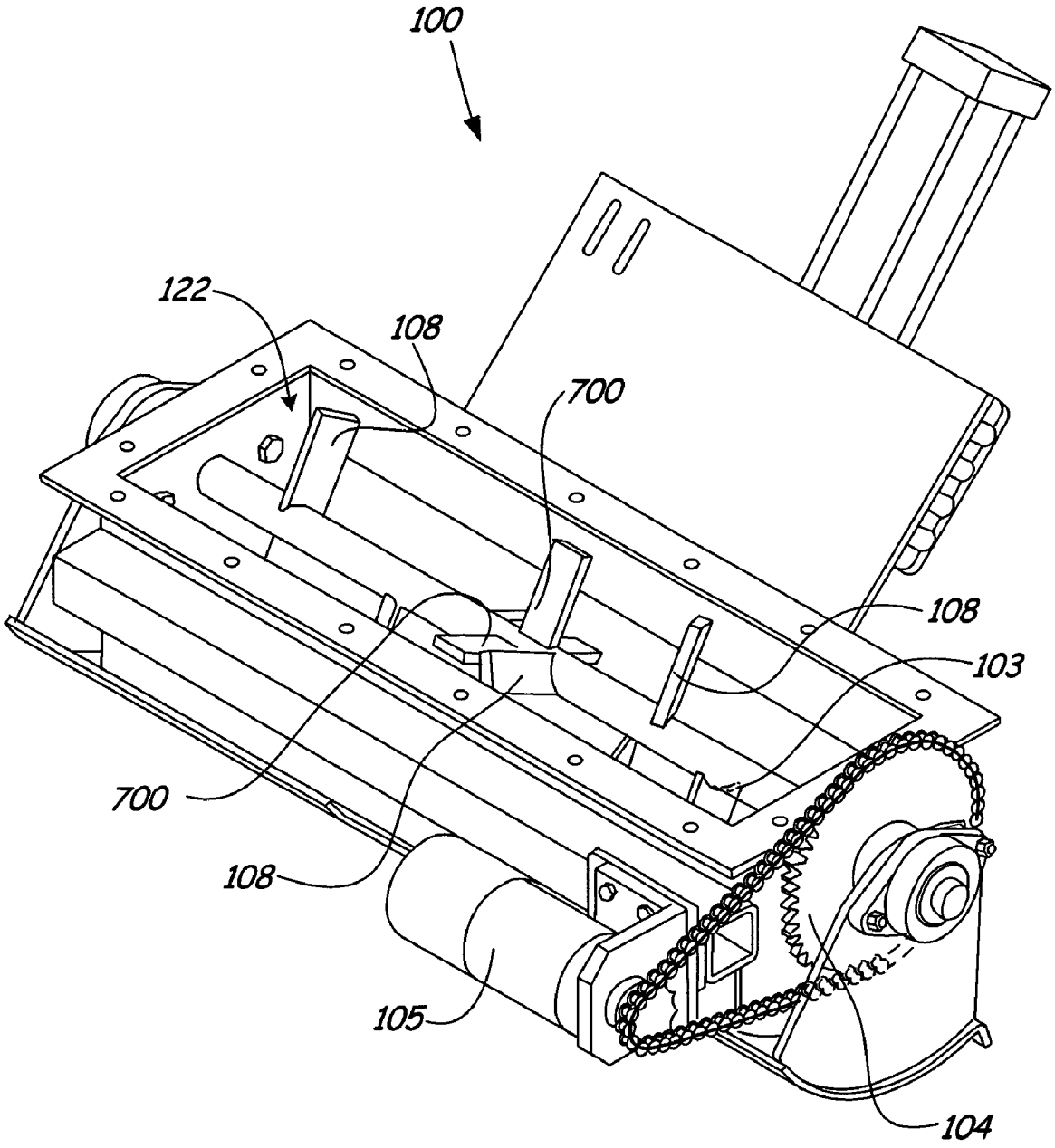
FIGS. 7-8 provide pictorial and top views of an assembly including a rotating shaft and an arrangement of paddles for directing flow of material within and out of the bin gate frame.
Figure 8:
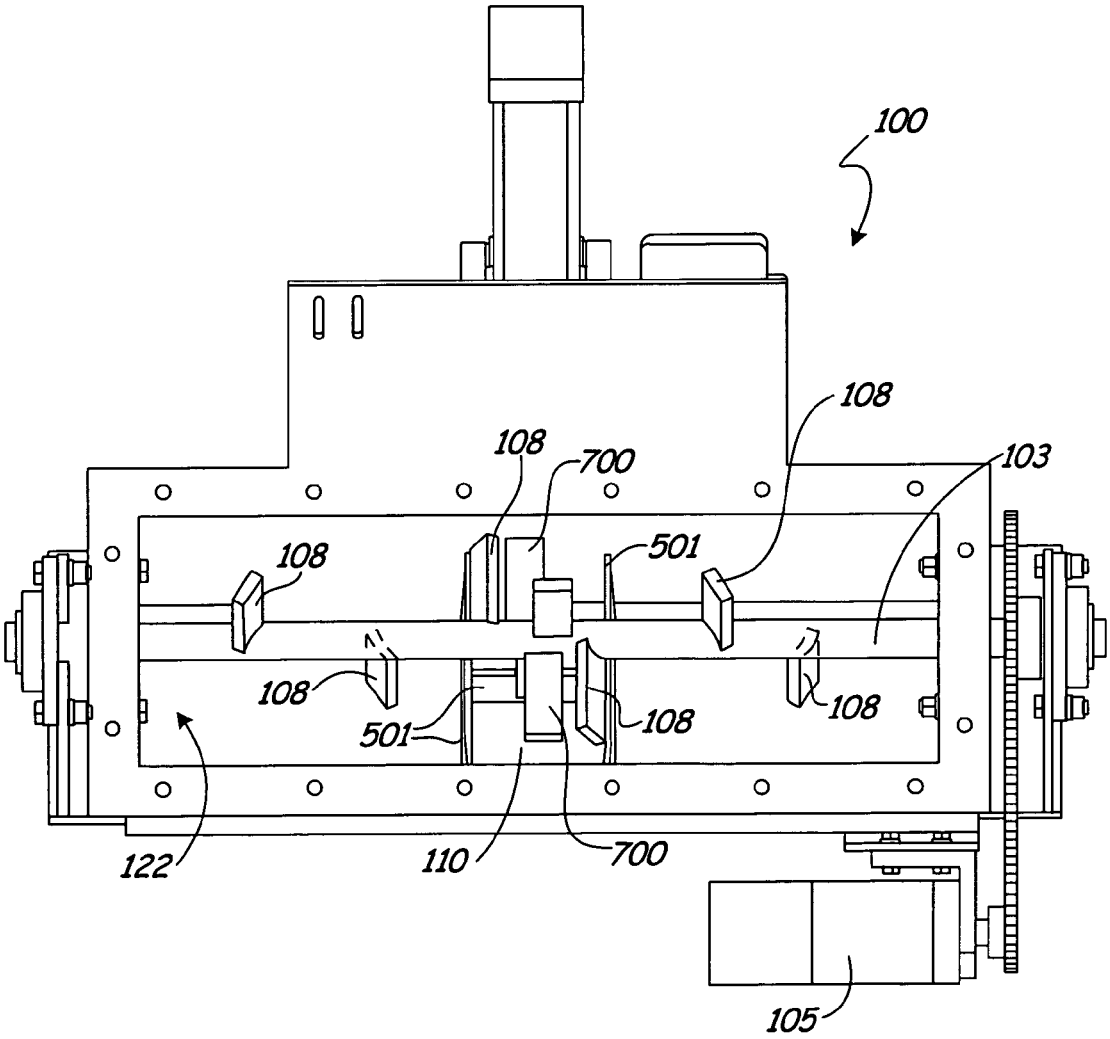

The flow enhancer components of assembly 100 that move the material in the bin toward the low flow aperture 110 and down through the aperture 110 during low flow output operation are shown in FIGS. 7 and 8. In FIG. 7, rotating shaft 103 carries paddles 108 positioned on the rotating shaft 103 at an angle such that rotation of the paddles 108 through the material in the bin tends to push the material toward the low flow aperture 110, which is centrally located in FIGS. 7 and 8 but may be located elsewhere in the bin as discussed above with reference to FIG. 1. Additional paddles 700 are positioned on the rotating shaft 103 above the low flow aperture 110 in order to agitate and/or push the material in the bin down through the vertical flow guide plates 501 surrounding the low flow aperture 110 and out of the low flow aperture 110 when the rotating shaft 103 rotates. As discussed above, rotating shaft 103 is rotated by motor 105 coupled to shaft 103 by gear-chain assembly 104.

FIG. 8 provides a diagram of the assembly shown in FIG. 7 viewed from a different angle. Paddles 108 and 700 are attached to rotating shaft 103. Paddles 108 are spaced along the rotating shaft 103 and configured primarily to impel the flow of material in the bin toward the low flow aperture 110. Paddles 700 are positioned and configured to break up and/or impel the material between flow guide plates 501 down and out through the low flow aperture 110 when the bin gate is positioned in the low flow output mode (e.g., shown in FIG. 5). Thus, the flow enhancer has two stages.

Figure 8A:
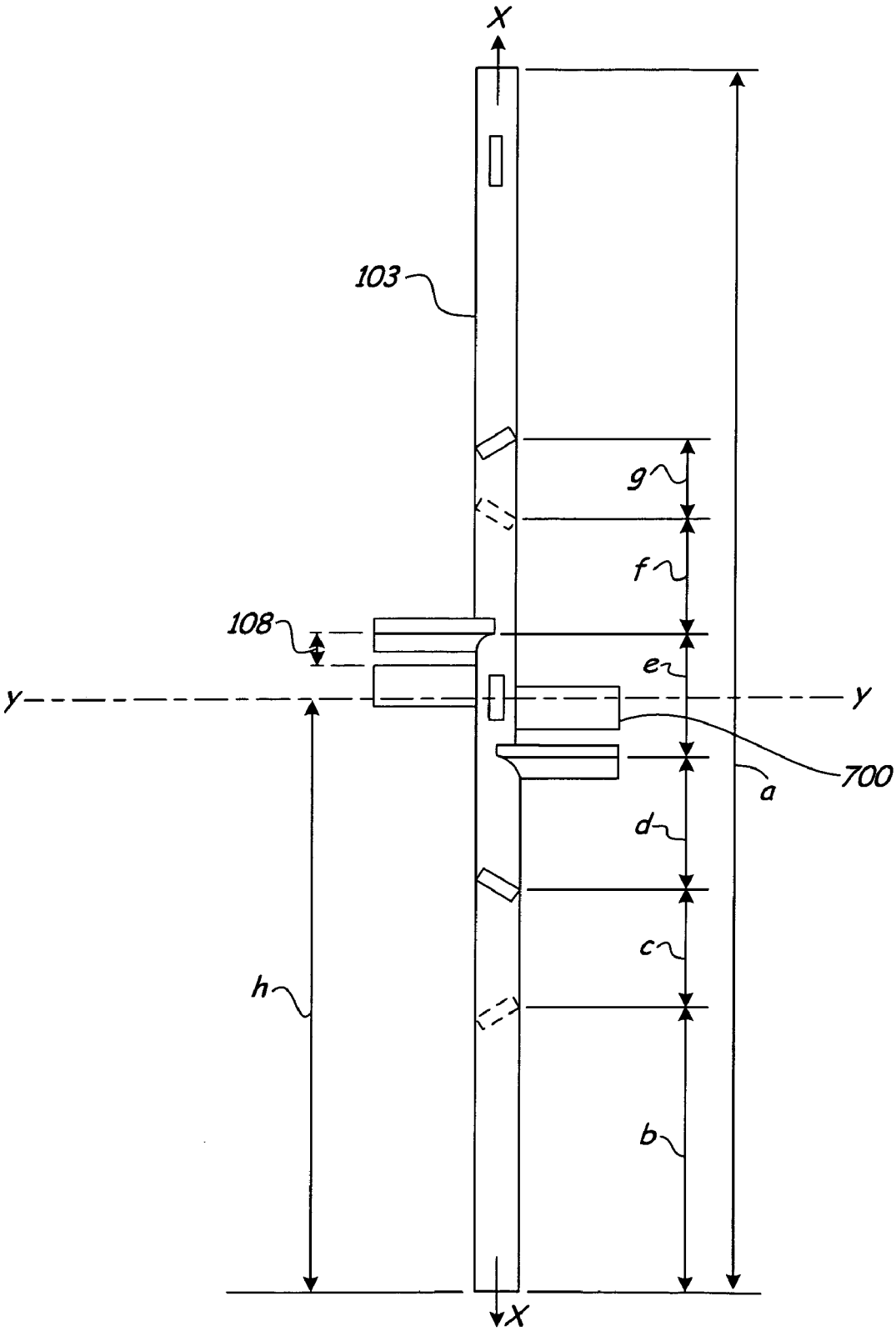
FIG. 8A provides a diagram of an exemplary arrangement of the rotating shaft and paddles.

In an exemplary assembly shown in FIG. 8A, paddles 108 are positioned at an angle of approximately 30 degrees relative to the longitudinal axis X of rotating shaft 103. Rotating shaft 103 has an approximate length "a" of about 44 inches. Measurements "b," "c," "d," "e," "f," and "g" indicate the spacing of the paddles 108 along the longitudinal axis X of the rotating shaft 103. Paddles 108 may be elongated and curved on one end to aid attachment to the curved rotating shaft 103 and have approximate dimensions of ½" by 1½" by 3¾". Paddles 700 may be flat bars having dimensions of about 0.5 inches in thickness, 1.5 inches in width, and 3.75 inches in length. Referencing FIG. 8A, the low flow aperture (not shown) is centered approximately midway between the ends of rotating shaft 103 as illustrated by measurement "h."

The assembly shown in FIG. 8A is provided as one example of the arrangement of paddles 108 and 700. However, the assembly is intended to include other paddle arrangements, different numbers and combinations of paddles, and alternative paddle shapes and sizes that are designed to break up and/or impel the material toward the low flow aperture 110 and then down through that aperture. For example, placement of the low flow aperture in a non-central location on the edge of the bin gate, such as positioning the low flow aperture on one end of the bin gate 102, would require different positioning of paddles 108 and 700 in order to accomplish the function of these paddles. Rounded or differently shaped paddles also may be used in place of substantially rectangular paddles shown in the figures.

Figure 9:
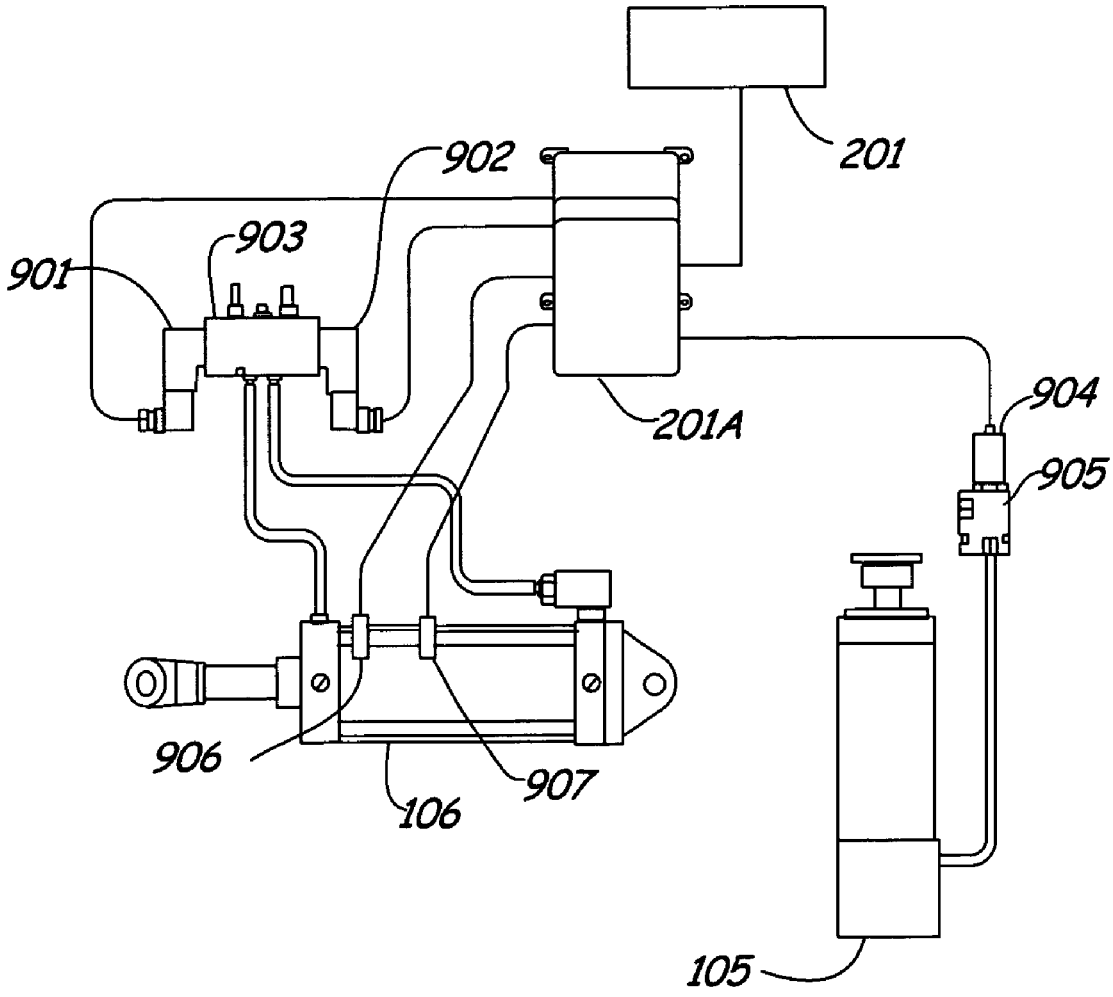
FIG. 9 illustrates an exemplary system for controlling operation of the bin gate.
Figure 10:
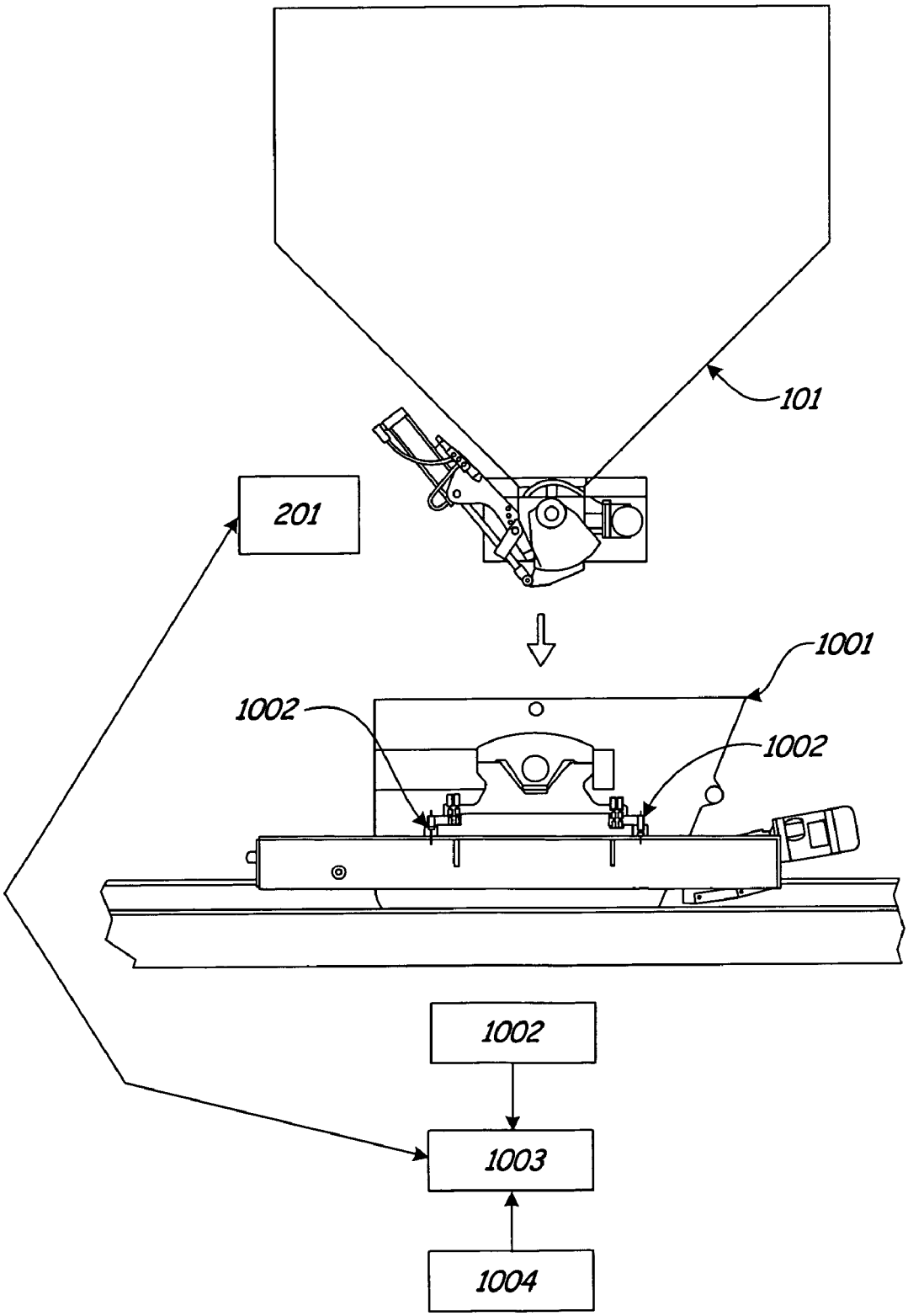
FIG. 10 illustrates an exemplary system for controlling operation of the assembly 100.
Figure 11:
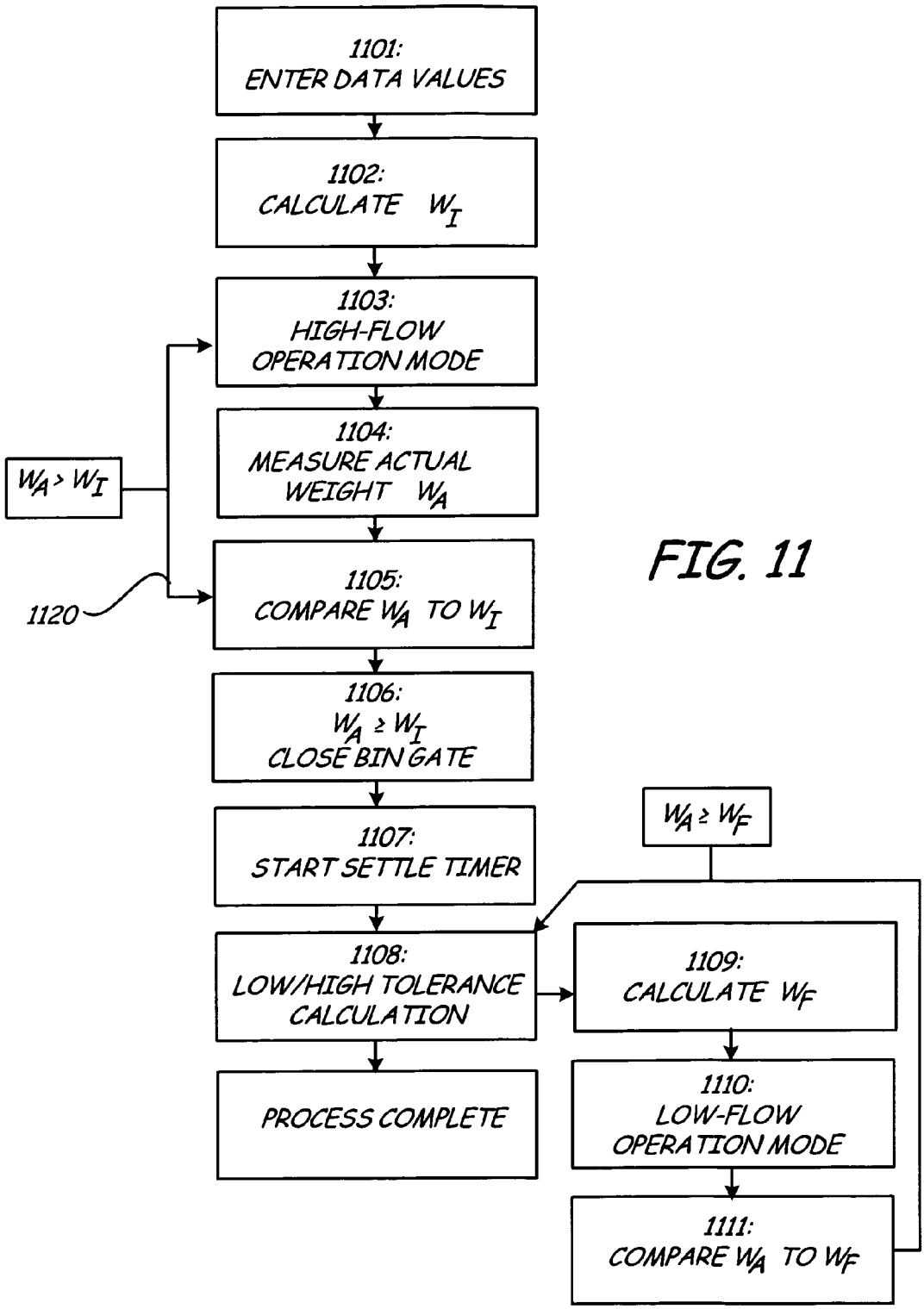
FIG. 11 provides a flowchart of a control process for controlling operation of the assembly 100.

A control mechanism for controlling the operation of assembly 100 in a batch mixing assembly will now be described with reference to FIGS. 9-11. FIG. 9 illustrates an exemplary system for controlling operation of the bin gate 102. FIG. 10 illustrates an exemplary system for controlling operation of the assembly 100. FIG. 11 provides a flowchart of a control process for operation of assembly 100. The control mechanism enhances the value of the high and low flow modes by automating the process of determining when to switch between modes and when a target amount has been dispensed.

In FIG. 9, a system for controlling operation of the bin gate 102 includes solenoids 901, 902, and 904; directional valves 903 and 905; and sensors 906 (gate closed) and 907 (low flow mode of operation). These components are used by computer 1003, controller 201 with controller junction box 201A to control operation of the actuator 106 and the motor 105.

FIG. 10 provides a diagram of an exemplary control system that may be implemented in the assembly. Weight sensors 1002 sense weight of material in the receptacle 1001. A controller device 201 is positioned on the bin gate assembly 100 to control and monitor the operation of the motor 105 and the actuator 106 of assembly 100 (see FIG. 2). The controller device 201 is in communication (e.g., wired or wireless) with an application program running on a data processing system, such as a programmable logic controller or computer 1003, that enables the operator to input and display the necessary values and control commands, e.g., via a keyboard or other data entry device 1004. Control commands are then communicated to controller 201 for positioning the bin gate 102 with actuator 106 and controlling the operation of motor 105, which rotates rotating shaft 103 via gear-chain assembly 104 (see FIGS. 1 and 2). The computer 1003 may also display target values and actual values measured, as well as component status or other information relevant to the control system.

Operation of the control systems in FIGS. 9 and 10 will now be described in further detail. Initially, an operator of the assembly 100 enters data values into the computer 1003 using data entry device 1004 to set the desired acceptable limits of material to be dispensed from the bin 101. For example, the operator may enter:

- a target weight $W_T$
- a high tolerance value $T_H$, which is added to the target weight and with $W_T$ sets the acceptable upper weight limit to be dispensed;
- a low tolerance value $T_L$, which is subtracted from the target weight and with $W_T$ sets the acceptable lower weight limit to be dispensed;
- a settle time value S, which represents the amount of time in seconds that the controller 201 will wait before taking a reading from the weight sensors 1002 after the bin gate 102 has closed (this time delay allows the scale to stabilize to produce a more accurate weight reading from sensors 1002);
- a high Pre-Act or threshold value $P_H$, which is subtracted from the target weight $W_T$ for an initial weight set point $W_I$, used when the high flow mode of operation is employed;

a low Pre-Act or threshold value $P_L$, which is subtracted from the target weight $W_T$ for a final weight set point $W_F$, used when the low flow mode of operation is employed; After entry of these values, the computer 1003 calculates the initial weight set point as follows: $W_T-P_H=W_I$. Typically $P_L \leqq P_H$, and $P_H$ is selected to be greater than the minimum amount that can be delivered by one open-close cycle of the low flow mode. Also, $P_L \leqq T_L$ usually, although this may vary according to the minimum amount that can be delivered by one open-close cycle of the low flow mode.

The computer 1003 then directs controller 201 to turn off solenoid 902 of directional value 903 and to turn on solenoid 901 of directional valve 903. This causes the actuator 106 to open the bin gate 102 to its full open position. Also, controller 201 turns on solenoid 904 of directional valve 905, which causes the motor 105 to rotate, rotating the shaft 103 in bin 101. The rotation speed of rotating shaft 103 is adjusted, for example, based upon the characteristics of the material in the bin 101 using a mechanical flow control valve (not shown) associated with the motor 105.

As material is dispensed into the receptacle 1001 in the high flow state, computer 1003 continually measures the actual weight $W_A$ on the scale as indicated by weight sensors 1002 and compares this value with $W_I$. When $W_A$ is equal to or greater than $W_I$, the computer 1003 directs controller 201 to turn off solenoid 901 and turn on solenoid 902. This causes the actuator 106 to move the bin gate 102 to the closed position. At the same time, controller 201 turns off solenoid 904 to stop the rotation of motor 105 and rotating shaft 103.

Next, the computer 1003 checks electrical sensor 906 for confirmation that the bin gate 102 is closed. If the bin gate 102 is closed, the controller starts a settle time (S) timer. When the settle time S has elapsed, the computer 1003 measures the actual weight $W_A$ of dispensed material as indicated by weight sensors 1002 and performs a low tolerance calculation by comparing $W_A$ to $(W_T-T_L)$. If $W_A>(W_T-T_L)$, the computer 1003 then performs a high tolerance calculation by comparing $W_A$ to $(W_T+T_H)$. If $W_A<(W_T+T_H)$, then the computer 1003 signals to the operator that the dispensing process is complete. This may occur when the tolerances around $W_T$ (i.e., $T_L$ and $T_H$, or the comparable percentages for yielding $T_H$ and $T_L$) are such that $W_T$ is achieved (within acceptable tolerances) using only the high flow mode of operation. For precision mixes, this is not usually the case. Also, if $W_A>(W_T+T_H)$, then the computer 1003 may generate an error (out of tolerance) signal.

If the low tolerance calculation indicates that $W_A<(W_T-T_L)$, the computer 1003 calculates the final weight set point $W_F$, which is $W_T-P_L$ where $P_L \leqq P_H$. The computer 1003 then signals the controller 201 to turn off solenoid 902 and turn on solenoid 901. This causes the bin gate 102 to start to open. When the bin gate 102 reaches a position that activates sensor 907 (low flow mode of operation), controller 201 turns off solenoid 901, causing the actuator 106 to hold the bin gate at the low flow position in which only the low flow aperture is open. The controller also turns on solenoid 904 to start operation of the motor 105 and rotating shaft 103. As material is dispensed from bin 101 in the low flow state, the weight sensors 1002 continually monitor the actual weight $W_A$ of the dispensed material, and computer 1003 compares $W_A$ to $W_F$. When $W_A \geqq W_F$, controller 201 turns on solenoid 902, causing the actuator 106 to return bin gate 102 to the closed position. Also, controller 201 turns off solenoid 904 to stop operation of the motor 105 and rotation of rotating shaft 103. Next, the computer 1003 checks electrical sensor 906 for confirmation that the bin gate 102 is closed. If the bin gate 102 is closed, the controller starts a settle time (S) timer. When the settle time S has elapsed, the computer 1003 measures the actual weight $W_A$ of dispensed material as indicated by weight sensors 1002 and performs a low tolerance calculation by comparing $W_A$ to $(W_T-T_L)$. If $W_A>(W_T-T_L)$, the computer 1003 then performs a high tolerance calculation by comparing $W_A$ to $(W_T+T_H)$. If $W_A<(W_T+T_H)$, then the computer 1003 signals to the operator that the dispensing process is complete. (Also, if $W_A>(W_T+T_H)$, then the computer 1003 may generate an error (out of tolerance) signal.) The process described above is repeated as necessary until the desired $W_T$ is dispensed. In this way, increased precision in the distribution of material from the bin 101 may be accomplished.

With reference to FIG. 11, the operator first enters data values (e.g., $W_T$, $T_H$, $T_L$, S, $P_H$, $P_L$ as described above with reference to FIGS. 9 and 10) for the material to be distributed from a bin (step 1101), e.g., as one ingredient for a batch of concrete to be mixed in a mixer such as the AcroMix™ batch plant available from Elk River Machine Co. of Elk River, Minn. In step 1102, initial weight set point $W_I$ is calculated: $W_T-P_H=W_I$.

In step 1103, operation of the assembly in high output flow rate mode is commenced. This mode corresponds to a fully open bin gate position, such as that shown in FIG. 6. During this mode of operation, rotating shaft 103 is rotating, for example, at a speed of approximately 20 RPM. The actual weight of the material distributed out of the bin 101 to a weighing receptacle is monitored (step 1104), preferably on a continuous basis, by one or more weight sensors (e.g., 1002 in FIG. 10) that are positioned to weigh the material distributed into the receptacle (e.g., receiving receptacle 1001 in FIG. 10) or onto a surface (e.g., a conveyor belt). The weight sensors provide the measured weight value to the control mechanism.

In step 1105, the distributed actual weight $W_A$ of the material in the receiving bin 1001 obtained from the weight sensors (e.g., 1002 in FIG. 10) and the initial weight set point $W_I$ are compared to determine how long the high flow output mode should be maintained. If $W_A<W_I$ (reduced by a threshold value), then the high flow output mode is maintained. This is continuously monitored in a control loop 1120. When $W_A \geqq W_I$ (reduced by a threshold value), then the controller 201 closes the bin gate 102. Here the threshold is used to determine when to switch from high to low flow mode.

In step 1106, the controller confirms that the bin gate 102 is closed.

In step 1107, if the bin gate 102 is closed, the controller starts a settle time (S) timer.

In step 1108, the controller performs a low tolerance calculation to determine if the target weight has been achieved, within the specified under-target tolerance. If $W_A>(W_T-T_L)$, the computer 1003 then performs a high tolerance calculation by comparing $W_A$ to $(W_T+T_H)$ to determine if the target weight has been achieved within the specified over-target tolerance. If $W_A<(W_T+T_H)$, then the computer 1003 signals to the operator that the dispensing process is complete.

If the low tolerance calculation indicates that $W_A<(W_T-T_L)$, the computer 1003 calculates the final weight set point $W_F$, which is $W_T-P_L$ (step 1109). The computer 1003 then signals the controller 201 to open the bin gate 102 to the low flow position and to start operation of the motor 105 and rotating shaft 103 (step 1110). In this mode of operation, actuator 106 positions the bin gate 102 such that only the low flow aperture 110 is open (as shown in FIG. 5). During this mode of operation, rotating shaft 103 rotates to impel the material in the bin gate frame 120 toward the low flow aperture 110 and then down and out through the aperture 110 as described above with reference to FIGS. 7, 8 and 8A.

As material is dispensed from bin 101, the weight sensors 1002 continually monitor the actual weight $W_A$ of the dispensed material, and computer 1003 compares $W_A$ to $W_F$. When $W_A \geqq W_F$, the controller closes the bin gate 102 and stops operation of the motor 105 and rotation of rotating shaft 103 (step 1111). The low tolerance test is performed to see if $W_T$ has been achieved or the low flow mode needs to be used further. Steps 1108-1111 are repeated until the desired $W_T$ of material is dispensed (within the tolerances). Performing final dispensing in the low flow mode permits a tighter tolerance around $W_T$ to be achieved.

In order to create a mixture of materials, such as needed to produce concrete, multiple bins, each having a corresponding bin assembly, e.g., as illustrated in FIG. 1, may be provided. Each bin may contain a different ingredient of the mixture to be produced. Multiple bin assemblies may be controlled by a single control system, wherein different values may be input for each ingredient to be dispensed from each bin. The above control sequence is then repeated for each new material and its associated data values. In this way, a mixture of multiple precisely measured ingredients may be obtained.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

We claim:

1. An assembly for controlling gravity flow delivery of granular or powdered material from a bin opening, comprising: a single movable bin gate for closing the bin opening and providing a high flow rate of material when the bin gate is open, wherein a low flow aperture is formed in the bin gate to provide a low flow rate of material when the bin gate is positioned such that only the low flow aperture is exposed to the bin opening; a controller for controlling positioning of the bin gate to select a flow rate of material from the bin opening; and a flow enhancer, for transporting and urging material to exit through the low flow aperture, a first stage of the flow enhancer comprising paddles positioned on a rotating shaft that extends across the bin opening such that the paddles are angled to impel material toward a second stage, and the second stage of the flow enhancer comprising paddles positioned on the rotating shaft to break up material bridging above the low flow aperture and angled to impel material in a gravity flow direction to exit the low flow aperture.

2. The assembly of claim 1, wherein the bin gate has an elongated shape and the low flow aperture is positioned along an edge of the bin gate and centrally in the dimension of elongation.

3. The assembly of claim 1, wherein the bin gate is a curved plate mounted for arcuate movement to expose selected portions of the bin opening.

4. The assembly of claim 1, wherein the low flow aperture is substantially rectangular in shape.

5. The assembly of claim 1, wherein the controller comprises: a sensor for providing an actual weight value of material present in a receiving receptacle for receiving a measured amount of material; and a memory for storing a target weight value for the weight of material in the receiving receptacle; wherein the controller adjusts the position of the bin gate to employ the low flow aperture in response to the actual weight value and the target weight value.

6. The assembly of claim 5, wherein the controller also adjusts the bin gate in response to one or more tolerance values defining proximity to the target weight value.

7. The assembly of claim 5, wherein the controller also adjusts the bin gate in response to one or more threshold weight values, wherein the one or more threshold weight values are less than the target weight value.

8. The assembly of claim 1, wherein the rotating shaft of the flow enhancer also supports the bin gate for arcuate motion to expose the bin opening selectively to the low flow aperture or a larger, high flow aperture.

9. An assembly for controlling delivery of granular or powdered material from a bin opening, comprising: a single movable gate for selectively closing the bin opening or providing a selected flow rate of material through the bin opening when the movable gate is open, wherein the movable gate has a notch formed in one edge to form a low flow aperture in the movable gate that provides a low flow rate of material when the movable gate is positioned such that only the low flow aperture is exposed to the bin opening; a controller for controlling operation of the movable gate to adjust a gravity flow rate of material from the bin opening; and a two-stage flow enhancer, with a first stage comprising paddles positioned on a rotor in the bin opening to impel material in the direction of the low flow aperture and a second stage comprising paddles positioned on the rotor to break up material bridging above the low flow aperture and to impel material to exit through the low flow aperture, the rotor comprising a shaft that also supports the movable gate for arcuate motion and positioning under control of the controller to select the low flow aperture and other open or closed gate positions.

10. The assembly of claim 9, wherein the controller comprises: a sensor for providing an actual weight value of material present in a receiving receptacle for receiving a measured amount of material; a memory for storing a target weight value for the weight of material in the receiving receptacle; wherein the controller adjusts the position of the bin gate to employ the low flow aperture in response to the actual weight value and the target weight value.

11. The assembly of claim 10, wherein the controller also adjusts the bin gate in response to one or more tolerance values defining proximity to the target weight value.

12. The assembly of claim 10, wherein the controller also adjusts the bin gate in response to one or more threshold weight values, wherein the one or more threshold weight values are less than the target weight value.

13. A method for controlling gravity flow delivery of granular or powdered material from a bin opening, comprising the steps of: providing at the bin opening a single movable bin gate with a low flow aperture; selectively positioning the bin gate using a single actuator to expose only the low flow aperture to the bin opening for material flow or to expose substantially all of the bin opening for material flow; and operating a flow enhancer, a first stage of the flow enhancer comprising paddles positioned on a rotating shaft that extends across the bin opening such that the paddles are angled to impel material toward a second stage, and the second stage of the flow enhancer comprising paddles positioned on the rotating shaft to break up material bridging above the low flow aperture and angled to impel material in a gravity flow direction to exit the low flow aperture.

14. The method of claim 13, wherein the step of providing at the bin opening a movable bin gate with a low flow aperture comprises providing a notch formed in one edge of the bin gate.

15. The method of claim 13, further comprising the steps of: providing an actual weight value of material present in a receiving receptacle for receiving a measured amount of material; accessing a target weight value for the weight of material in the receiving receptacle; and adjusting the position of the bin gate in response to the sensed weight value and the target weight value.

16. The method of claim 15, wherein the bin gate is also adjusted in response to one or more tolerance values defining proximity to the target weight value.

17. The method of claim 15, wherein the bin gate is also adjusted in response to one or more threshold weight values, wherein the one or more threshold weight values are less than the target weight value.

18. The method of claim 13, further comprising supporting the bin gate on the rotating shaft of the flow enhancer for arcuate motion to expose the bin opening selectively to the low flow aperture or a larger, high flow aperture.

* * * * *